United States Patent [19]

Desjardins

[11] 4,375,637

[45] Mar. 1, 1983

[54] INTEGRATED ALARM, SECURITY, BUILDING MANAGEMENT, AND COMMUNICATIONS SYSTEM

[75] Inventor: Paul A. Desjardins, Commack, N.Y.

[73] Assignee: Firecom, Inc., Woodside, N.Y.

[21] Appl. No.: 237,801

[22] Filed: Feb. 24, 1981

[51] Int. Cl.[3] ..... G08B 29/00; G08B 23/00

[52] U.S. Cl. ..... 340/517; 340/505; 340/506; 340/507; 340/525; 340/531; 340/825.06; 340/825.54; 340/825.55; 179/5 R

[58] Field of Search ..... 340/517, 518, 522, 505, 340/506, 507, 508, 524, 525, 531, 534, 536, 538, 152 T, 151, 152 R, 870.09, 870.14, 870.16, 825.24, 825.56, 825.06-825.14, 825.52, 825.54, 825.55; 179/5 R, 5 P, 1 A, 1 R, 1 B, 1 D, 1 GJ, 1 MN, 1 P

[56] References Cited

U.S. PATENT DOCUMENTS

| | | | |
|---|---|---|---|
| 3,350,687 | 10/1967 | Gabrielson et al. | 340/151 |
| 3,516,063 | 6/1970 | Arkin et al. | 340/505 |
| 3,803,594 | 4/1974 | Klein et al. | 340/518 |
| 3,921,168 | 11/1975 | Dunban | 340/152 R |
| 3,990,075 | 11/1976 | Schmitz et al. | 340/502 |
| 4,019,172 | 4/1977 | Srodes | 340/152 T |
| 4,030,095 | 6/1977 | Dalman | 340/518 |
| 4,067,008 | 1/1978 | Sprowls | 340/152 T |
| 4,097,690 | 6/1978 | Kuntz et al. | 179/5 R |
| 4,258,332 | 3/1981 | West | 179/1 A |

*Primary Examiner*—John W. Caldwell, Sr.
*Assistant Examiner*—Donnie L. Crosland
*Attorney, Agent, or Firm*—Nolte and Nolte

[57] ABSTRACT

A fully integrated alarm, communication, and building management system has a central control station and a plurality of remotely located sensing and controlling devices. Each remote device has an individual digital address, which is a parallel address present on a plurality of parallel lines. The parallel address is converted to a serial address and sent to the various remote locations where it is then reconverted to a parallel address and decoded to determine the specific device being interrogated. A multiple amplifier system is provided at the central control unit and provides communication capability involving remotely located loudspeakers and microphones. The amplifiers are provided in a dual channel arrangement so as to provide a fail-safe arrangement and a failure detector is located in each channel such that if a selected amplifier channel fails, the back-up or redundant channel is immediately switched into use. A number of controlling devices or actuating devices may be employed which operate in conjunction with the sensing devices and a programmable read only memory, or a programmable multiplexer, located at the central control unit. Each remotely located controlling or actuating device also has associated with it an individual parallel digital address and upon the occurrence of a signal from a sensing unit indicating a condition other than a normal condition and a specific address programmed into the programmable read only memory or the multiplexer a command signal will be issued to the remotely located actuating or controlling device causing such device to operate in a predetermined manner.

17 Claims, 6 Drawing Figures

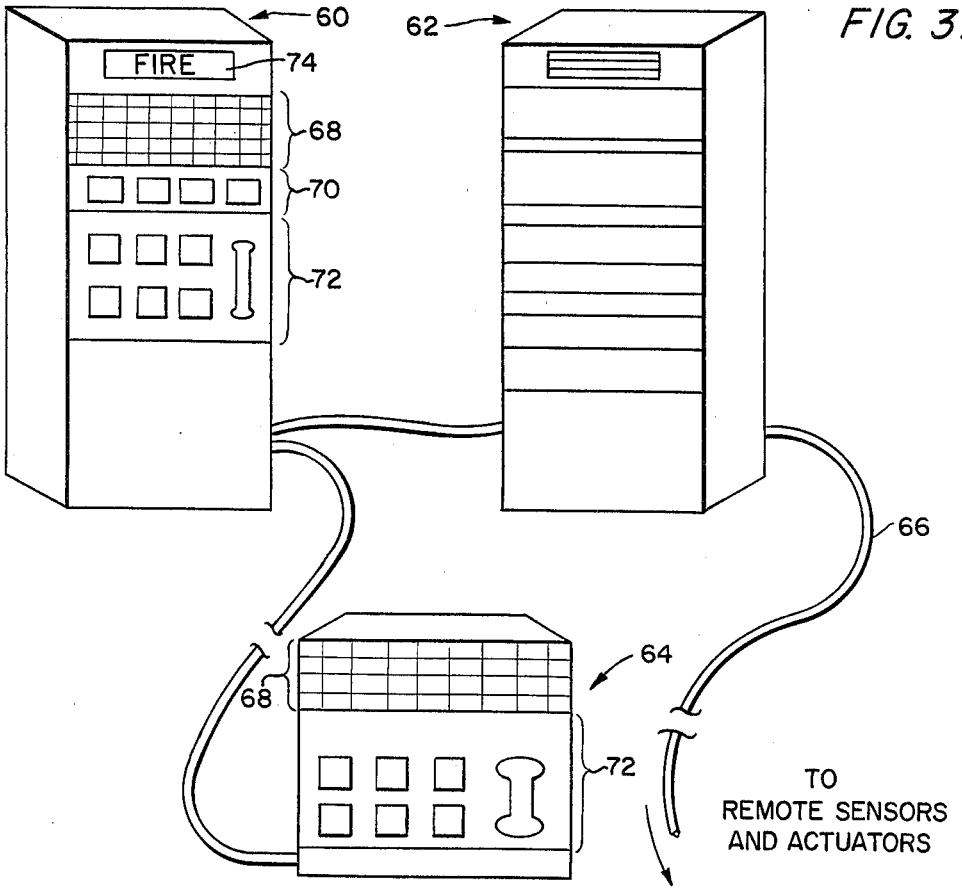
FIG. 3.
FIG. 5.
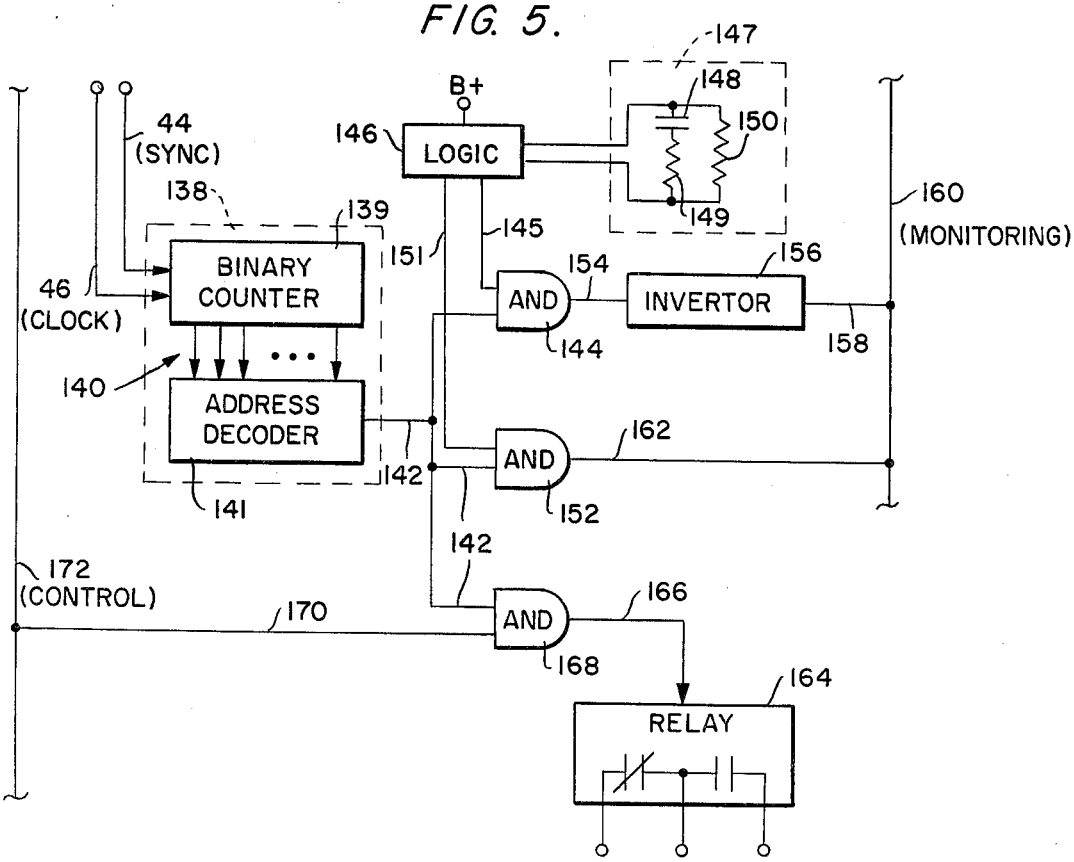

INTEGRATED ALARM, SECURITY, BUILDING MANAGEMENT, AND COMMUNICATIONS SYSTEM

BACKGROUND OF THE INVENTION

The present invention relates in general to alarm systems for use in large buildings and, specifically, relates to alarm, security, communications, and building maintenance systems.

Recently enacted national and local safety codes have required public buildings, such as large office buildings and the like, to be provided with fire alarm systems to ensure the safety of the building occupants. While fire alarms are generally well known, such systems become expensive when there are a large number of fire and smoke detectors involved, due to both the large number of wires required and the time needed to install the wiring in the building. Additionally, other systems, such as security and communications, are frequently used in large buildings and these systems also add to the large number of wires and increase the cost of the overall system.

Because presently known systems are not integrated a great deal of wiring duplication is present. This not only increases the costs but also adversely affects the reliability of the installation. Also, it has been found that communication and building management are not merely a luxury but are very important, since when an emergency situation exists it is important for the fire and safety personnel to speak with the affected areas. It is also advantageous to be able to control remotely various devices such as elevators, fans, door strikes, and the like.

SUMMARY OF THE INVENTION

The present invention provides a totally integrated system, wherein several different types of devices, such as smoke detectors, manual fire alarm stations, and sprinkler waterflow switches are integrated into a single system which includes means to display automatically the status of these several devices. A communications system including amplifiers and loudspeakers for sounding an alarm and for paging from either a floor warden's station or a central fire command station is integrated into the system, along with a remote annunciator panel located at the regularly assigned location of the fire safety director. Means are provided for remotely controlling certain operating devices of the building, such as door strikes, elevator fans, and the like.

The present invention utilizes an improved identification system, which permits the use of a minimum number of wires to identify the several sensing stations and to control the several operating stations located throughout the building. An example of this improved identification system and a preferred embodiment thereof are disclosed in my pending application Ser. No. 193,689 filed Oct. 3, 1980, now U.S. Pat. No. 4,342,985 issued Aug. 3, 1982, which disclosure is incorporated by reference herein and which is assigned to the assignee hereof. An overall fire protection system is provided which comprises a binary-coded, parallel-connected smoke detection and alarm system, which is intended to meet all local and national fire codes. Alarm initiating devices, such as smoke detectors, heat detectors, product of combustion detectors, and the like, are utilized along with manual alarm stations, sprinkler waterflow systems, and the like. A multiplexer system may be utilized which can include a programmable read only memory (PROM) or a minicomputer to provide programmable control over the operation of the actuating devices located throughtout the building. Such actuating devices are the fans and door strikes previously mentioned.

The use of this programmable capability in the present invention provides a security system which allows for monitoring and control of door and window sensors, as well as area motion detectors. The binary coded switching and display system allows continuous monitoring and display of all points located througout the building. Additionally, a hard-copy printer permits all events to be permanently recorded. The present invention includes an internal supervisory system which operates such that wiring faults are continuously monitored and any internal faults will be immediately identified and displayed and/or recorded at the central control console.

The communication system taught by the present invention provides both a paging capability and a selective talk telephone system. The paging system also functions to provide audible signals utilized in the fire protection system. Background music and programmed messages may also be sent over the communication system.

The invention operates as a building management system by permitting building operating personnel to control manually or automatically, fans, dampers, pumps, and lighting circuits located throughout the building. The binary-coded multiplexing circuitry employed in the present invention permits multiple control and display functions to be accomplished over common dedicated cabling, thereby minimizing installation and system expansion costs. The PROM and/or minicomputer or microprocessor may be easily expanded to have a memory from 32K to 300 megabytes.

Therefore, it is an object of the present invention to provide an integrated system for use in large buildings, which system includes a fire protection system, a security system, a communication system, and a building management system all operating over common cabling.

It is another object of the present invention to provide an integrated security and building communications system which utilizes a minimum number of wires to interconnect the various sensing outputs.

It is still another object of the present invention to provide a system for use in large buildings, wherein operating devices in remote locations can be automatically actuated in response to an alarm signal from such remote location.

The manner in which these and other objects are accomplished by the present invention will become clear from the following detailed description.

BRIEF DESCRIPTION OF THE DRAWINGS

FIG. 3 is a pictorial representation of the principal control ements of the present invention.

FIG. 5 is a circuit diagram showing a remote transponder alarm, trouble, and command portion of the present invention.

DETAILED DESCRIPTION OF THE INVENTION

The present invention is an integrated, comprehensive system for gathering data from outlying automatically and manually operated devices, displaying conditions throughout the system, activating fire alarm devices and other building equipment such as elevators, ventilating fans, etc, and for providing a communication system between a central fire command station and the rest of the remote locations throughout the building.

Figure 1:
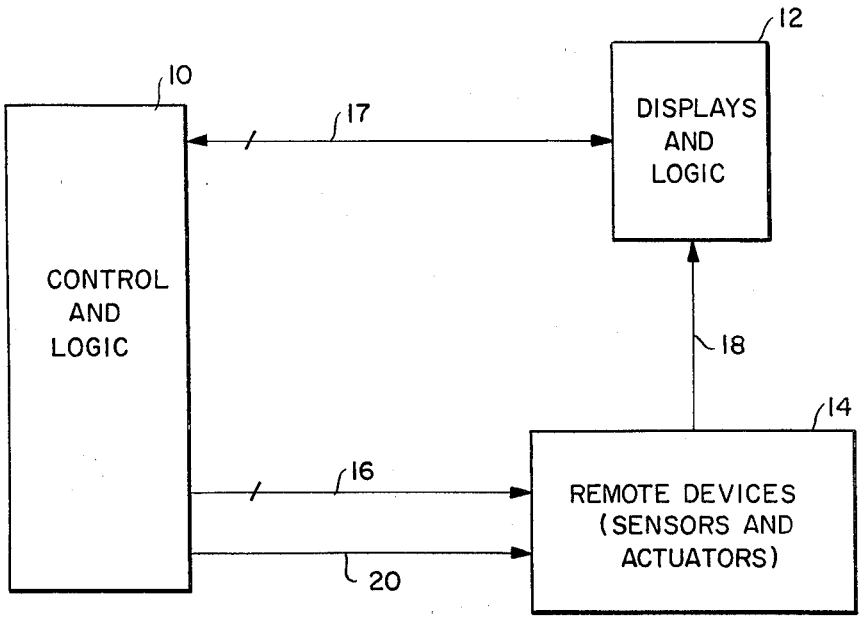
FIG. 1 is a block diagram of the present invention.

Referring to FIG. 1, a simplified block diagram shows the three principal elements of the system, i.e., the control and logic unit 10, the display and logic unit 12, and the remote devices 14, such as the sensors and actuators. The control and logic unit 10 generates a sequence of address signals, clock signals and sync signals. The clock and sync signals are fed to each of the remote devices, such as the sensors, manual alarms, and the like on line 16. The address signals are fed to the display and logic unit 12 on line 17. The remote devices 14 can generate one of three signals, (1) either a normal condition, (2) an alarm condition, or (3) a trouble condition. These three signals are fed on monitoring line 18 to the display and logic unit 12. The display and logic unit 12 will then provide a visual and/or audible indication whenever an alarm is initiated or if there is a failure condition sensed among any of the remote outlying sensors. The control and logic unit 10 also provides command signals on line 20 which are fed to the remote devices and specifically to the actuators, which may comprise loudspeakers, door latches, fans, elevator, etc.

Figure 2:
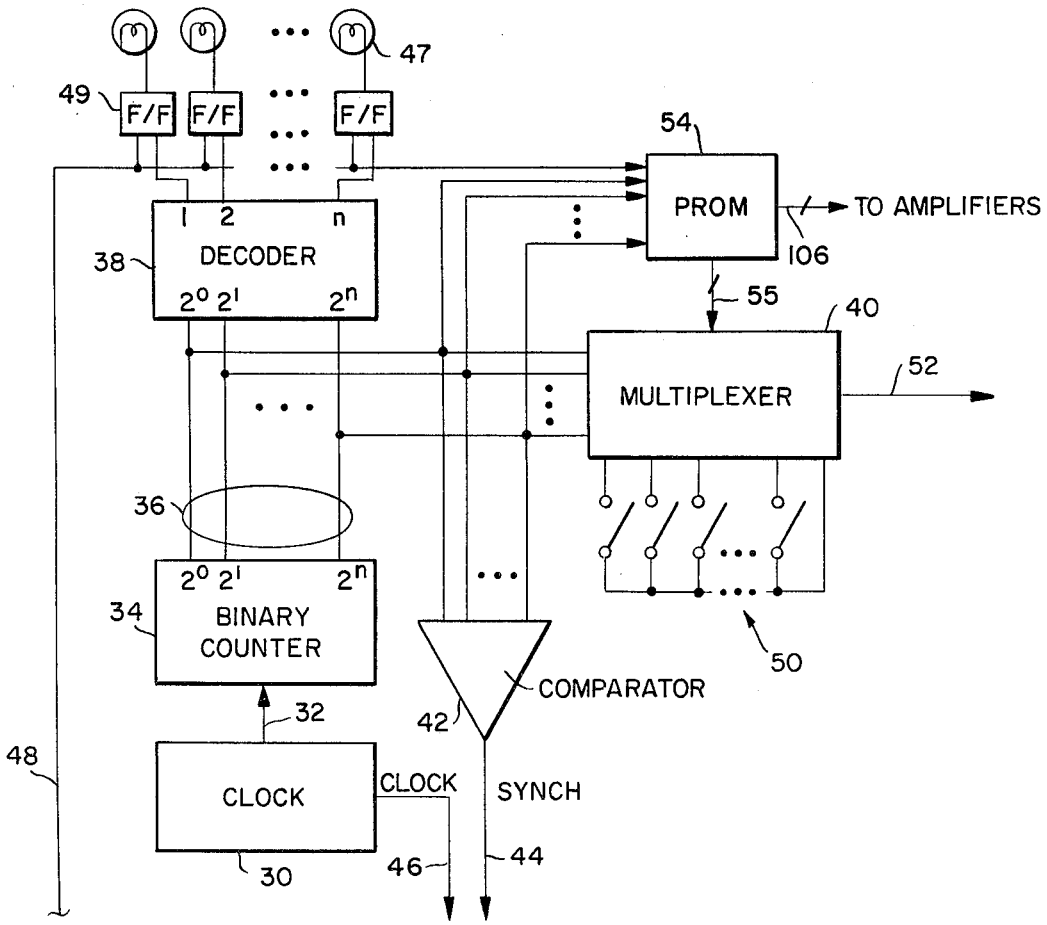
FIG. 2 is a block diagram showing a portion of the invention of FIG. 1 in more detail.

FIG. 2 shows the control and logic unit 10 and the display and logic unit 12 of FIG. 1 in somewhat more detail. Specifically, a clock signal generator unit 30 provides serial clock pulses on line 32 which is connected to a binary ripple counter 34. The binary counter 34 produces a number of parallel output signal lines 36. The output signal lines 36 are energized or made high depending upon the cumulative number of clock pulses which have appeared on line 32 and have been counted by the binary counter 34. In the present embodiment, the maximum number of output lines corresponding to the total count of the counter 34, is 1,024. Accordingly, it may be advantageous to provide a clock 30 which produces a signal on line 32 having frequency of 1,024 pulses per second (Hertz), in this manner a total of 1,024 addresses may be generated each second. The address lines 36 are connected to a decoder 38, to a multiplexer 40, and to a comparator 42. The comparator 42 determines when all of the lines 36 have gone high, i.e., are 1 and then produces a sync signal on line 44, which is connected to all outlying devices. Similarly, a clock signal from the clock 30 is fed to all outlying devices on line 46. This is the same clock signal as on line 32. Once the sync signal on line 44 is produced by the comparator 42 the remote address counting starts all over again.

Each remote sensing device is assigned a particular address and is also assigned a corresponding indicator lamp, shown typically at 47. When a remote device is addressed with the appropriate serial address by the clock line 46 and the sync line 44 and as converted to the parallel address of the individual remote device, and such remote sensing device is in a normal, trouble, or alarm condition, a signal will be sent back to the main control panel on the monitoring line 48. The coincidence of a trouble or alarm signal on the monitoring line 48 with the appropriate address from the corresponding remote sensing unit triggers a flip-flop unit 49, which will energize the particular lamp 47 in the display unit. It should be noted from FIG. 2 that two inputs to a flip-flop unit 49 are required in order to energize a lamp, specifically, a trouble or alarm condition on the monitoring line 48 and the appropriate address of the sensor providing the trouble or alarm signal being produced from the binary counter 34 and decoded by the decoder 38.

The multiplexer 40 is provided with manually actuatable switches, shown diagrammatically at 50. The number of these switches corresponds to the number of signal lines 36 and, thus, it is possible by selecting the appropriate state of each of the switches to manually insert the address of a particular remote device. Thus, when the switches 50 have been arranged such that the particular actuating device has been selected, and the address for the selected actuating device appears on lines 36, the multiplexer 40 will produce a control signal on line 52. It should be understood that these same switches 50 can be used to select a different remote device upon each subsequent cycle of all the addresses merely by resetting the switches 50 to the desired remote device address after each cycle.

Additionally, the multiplexer 40 can be used in conjuction with a programmable read only memory (PROM) 54 into which has been programmed the addresses of the remote actuating devices so that when the address of a particular remote device is produced from the binary counter simultaneously with an alarm signal on the monitoring line 48, the address will be sensed by the programmable read only memory, a command signal fed on line 55 to multiplexer 40 and the control signal produced by the multiplexer 40 on line 52. Similarly, a minicomputer connected to receive the addresses from the binary counter 34, and the signals on line 48 could be utilized to accomplish the same function by programming into the minicomputer the addresses of the remote devices which should be controlled in the event of an alarm signal on line 48.

Referring now to FIG. 3, a pictorial representation of the hardware embodiment of the present invention is set forth. Specifically, the freestanding unit 60 represents the fire command station, the freestanding unit 62 represents the amplifier rack and the unit 64 in the foreground, represents, the remote annunciator panel. These three units are operationally interconnected by multiconductor cables. Additionally, emanating from the amplifier rack 62 is a cable 66 fed to the remote sensors and actuators located up the building. The fire command station 60 is essentially the control center of the present inventive system. The cabinet shown generally at 60 will contain the control logic, the display logic, as well as the audio controls for the system. More specifically, the fire command station 60 will contain an annunciator panel 68, a multi-function panel 70, and an audio control panel 72. Also provided in this fire command station 60 is a large sign or visual indicator 74, which can be energized to provide a flashing light displaying the legend "FIRE".

The annunciator panel 68 is the visual display portion of the fire command station and employs a plurality of bays of indicator sections with each section having a predetermined number of vertical units. In the preferred embodiment, each horizontal column represents a floor of the building. A sufficient number of bays are provided to represent all of the floors and levels of the building. Typically, the annunciator panel 68 is divided into vertical columns and the number of columns depends upon the number of types of outlying or remote devices employed in the particular installation. As an example of some of the columns there might be water-flow switches, elevator lobby smoke detectors, manual fire alarm stations, area ionization detectors, supply air duct ionization detectors, return air duct ionization detectors, and dampers. Thus, for each of the functional columns representing a protection or alarm device, there is an appropriate position in the bay for each floor. It is also advantageous to provide different colored lights so that one can distinguish between a system failure and a system alarm. Also provided in the annunciator panel 68 are switches and indicators which enable communications between the fire safety director and the appropriate floor warden. If the floor warden wishes to communicate with the fire safety director at the command control station, the floor warden operates the appropriate switch at the warden's station, a pulsing audible signal is emitted, and the indicator lamp corresponding to the particular warden station is activated. Once the fire safety director has been signaled by the floor warden, the fire safety director may then depress the command switch on the audio control panel and maintain a verbal conversation with the floor warden.

Located in the fire control station is the audio control panel 72 which provides a group of summation lamps, a test lamp panel, an alarm acknowledging panel, alarm and trouble sound alerts, and a monitoring speaker. The alarm acknowledge section of the audio control panel 72 and the multi-function panel 70 respond to a transponder alarm condition when one such condition occurs. When a fire condition is detected, the indicator on the annunciator panel is illuminated and the corresponding device-type indicator on the multi-function panel 70 will also be illuminated. Simultaneously, an alerting signal will be sounded to alert the operator. Additionally, an evacuation tone is sounded on the floor on which the alarm has been detected, as well as on the floor directly above the affected floor. The operator may eliminate the coordinating tone at the fire command station by depressing an alarm acknowledge button. Because the inventive system also detects a failure in any of the remote sensing devices, a corresponding trouble signal will be present at the annunciator panel. A tone will be generated and a lamp indicating a transponder missing or failure mode will be illuminated. While the continuous tone may be stopped by depressing a silence button, the trouble lamp will remain lit to indicate that the trouble has indeed been noted. Once the trouble has been corrected, the tone will be regenerated and the lamp will go out. The silence button must then be depressed to return the system to normal and eliminate the tone.

The audio control panel includes a number of special control sections for monitoring and controlling the audio, central station, and smoke detection system operation. For example, the special functions section has two or more pushbutton switches which provide special control functions from the fire command station, such as a "smoke reset" switch to reset the smoke detection portion of the system, a "door release" pushbutton to deactivate all electric door strikes on the doors to the fire stairs, and a "nighttime" switch which is intended for use in a building when there is minimal activity during the nighttime hours and which could be used to send an alarm signal to the entire building, as opposed to the specific floor during normal working hours. The special function section can also employ a "fan" switch to shut down automatically the building ventilating fans during alarm conditions and to activate the stairwell fans to pressurize the escape stairs. A "page" switch is provided with which the fire safety director can allow a floor warden to make paging announcements to selected floors. Under an alarm condition, the floor on which the alarm is sensed, and the floor directly above, are automatically enabled for floor paging. If the warden-page switch is operated, the floor warden is able to use the telephone handset to give instructions to the occupants of the affected floors. Additional floors can be included in the floor warden instructions, if they are enabled by depressing a "floor page" switch on the annunciator panel. The fire safety director, however, can supersede or override the paging announcements of a floor warden by utilizing a push-to-talk microphone located at the audio control panel. Also provided in the audio control panel is a "stair page" which permits the fire safety director to instruct evacuating of the occupants in the fire stairs and an "all-call" switch, which permits the fire safety director to issue instructions or make announcements over all corridor loudspeakers in the building, not including the fire stairs.

There are also indicating lamps and switches for the overall alarm system located at the audio control panel and such controls are the "central station alarm/set" indicator, which shows that an automatic alarm signal has been directed to the central office transmitting system equipment, a "signal-on" indicator which shows the evacuation signal is being sent to the alarm floors, and a "signal-off" switch which discontinues sending the evacuation signal over the loudspeaker. A "manual trip switch permits the fire safety director to initiate manually an alarm signal to the central office transmitting equipment and also to illuminate the central station alarm indicator. A manual evacuation switch is provided to initiate the evacuation signal to the selected floors via the loudspeakers.

The remote annunciator panel 64 is provided for the use of the fire safety director and/or the building manager, and this unit consists of an annunciator panel, corresponding to that shown at 68 in the fire command station, and an annunciator control panel, corresponding to that shown at 72 in the fire command station 60. The remote annunciator 64 contains the annunciator portion 68 which is similar to the panel in the fire command station 60, however, in place of the individual displays of all functions for each floor, only a "Floor" display is provided to indicate the floor of the alarm or touble for the floor-page transponders. The pushbutton switches at the annunciator panel 68 are used to control the ventilating fans and can also be used to select a floor for paging or a floor warden in the same manner as discussed above relative to the annunciator panel of the fire command station. The annunciator control panel 72 of the remote annunciator panel 64 employs a switch panel, an alarm signal, a selector switch, and a handset. The switch panel 72 has a trouble indicating lamp or system trouble lamp which indicates there is a system failure at one of the remote sensing devices. At the same time a system failure is detected, an alarm signal is generated at the alarm signal zone of the panel. A switch is provided to discontinue the alarm signal. Also provided is a talk/pull-to-call fire command station selector switch, which is used to select the operation of the handset located in the audio control panel 72. The operator of the remote annunciator panel initiates a call to the fire command station by pulling this selector switch and the fire safety director then responds by utilizing his handset to conduct the appropriate communications. When the selector switch is in the "talk" position, the operator of the remote annunciator panel can communicate with other floor warden stations as necessary and as selected by the fire safety director at the annunciator panel located in the fire command station.

Referring to the amplifier rack 62, amplifiers are located in this rack which are necessary to operate the corridor, elevator lobby area, and stair loudspeakers for transmitting the fire safety signals, the evacuation signals, and paging announcements. Preferrably the amplifier racks 62 are located in a protected area within the building. In addition to the main power amplifiers for alarms and paging, a smaller amplifier is provided for use by the warden to drive the monitor loud speaker located at the multi-function panel of the fire command station 60.

Figure 4:
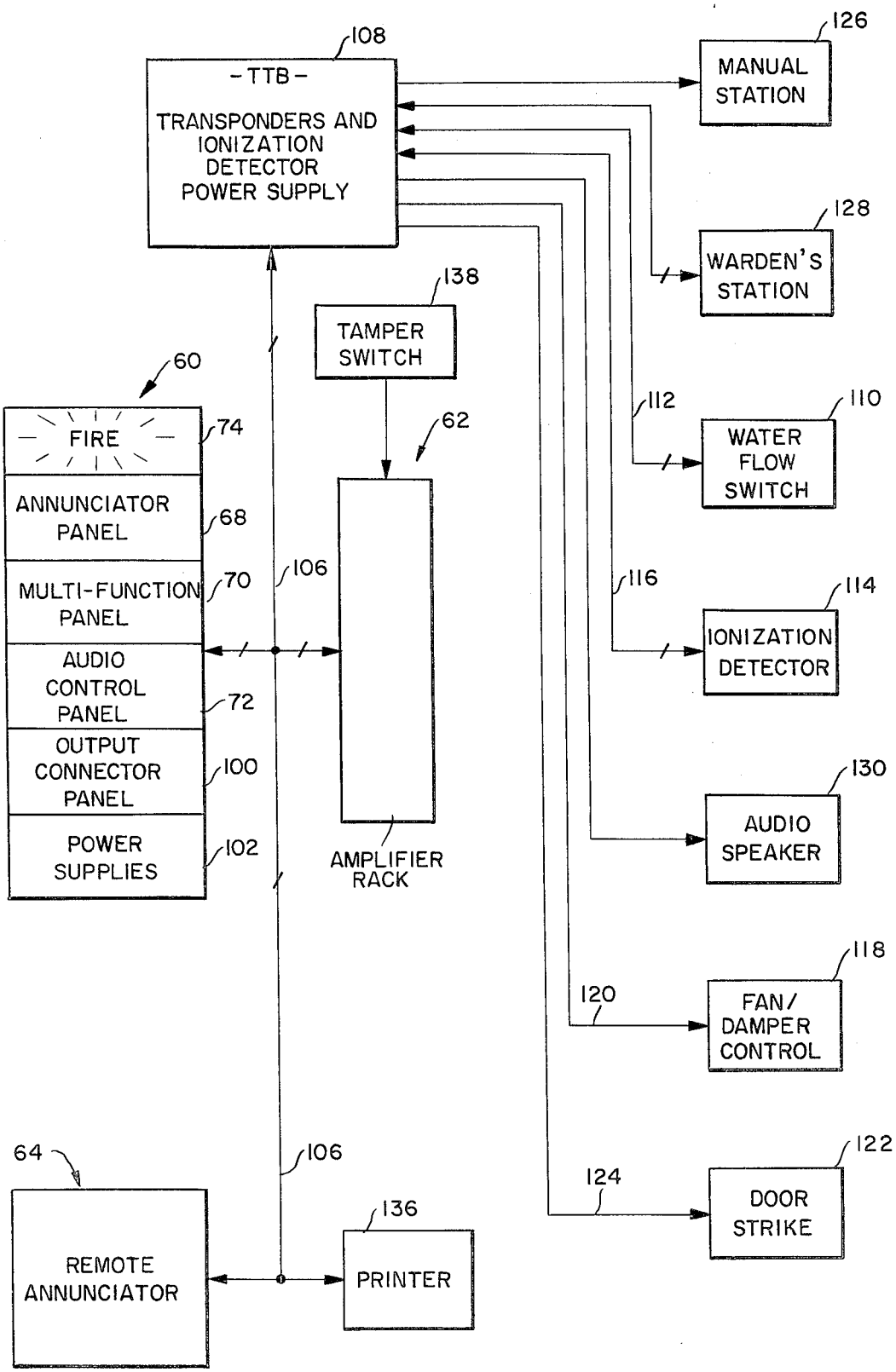
FIG. 4 is a circuit diagram of the control and display system of the present invention.

Turning now to FIG. 4, the principal elements of the present invention are shown in block diagram form. Specifically, the fire command station 60 is shown including the functional blocks of a visual fire alarm indicator 74, the annunciator panel 68, the multi-function panel 70, and the audio control panel 72. Also provided is an output connector panel 100 for interconnection with the fire station or centrally located alarm system. Another functional block is a power supply unit 102 which contains the necessary transformers and the like to provide the appropriate voltage levels necessary for the operation of the system.

The fire command station 60 is connected with the remote annunciator 64 by multi-lines 106 with the amplifier rack 62 and the transmission terminal box (TTB) 108. The TTB unit 108 functionally contains all of the transponders. The remote devices, such as the sensors and actuators, which were generally shown at 14 in FIG. 1 are shown with greater specificity in FIG. 4. Specifically, a waterflow switch 110 is connected to the TTB unit 108 via lines 112 and is used to determine whether the automatic sprinkler system has been set off, and an ionization detector 114 acts as a smoke detector and communicates with the TTB unit 108 on multi-lines 116. These units are examples of the typical type of sensor which may be employed in the inventive system. Similarly, as examples of actuators, a fan/damper control unit 118 is connected to the transponder unit 108 by lines 120, and a door-strike unit 122 is provided which can operate the door strikes at various doors in the building. These units are examples of actuators which might be used in the present invention. It is understood that these units are either interrogated or caused to be actuated only when their particular address is generated from the fire command station, i.e., when that address arrives at the TTB unit 108 and is fed to the particular remote unit. Also connected to the transmission terminal box 108 is a manual alarm station 126, as well as several warden stations, one of which is shown at 128. The several audio speakers located throughout the building are shown typically at 130 and are connected on line 132 through the TTB unit 108 to the amplifier rack 62 and the fire command station 60. The audio speakers 130, as well as the several warden stations 128, get audio signals from the amplifier rack 62 and from the remote annunciator panel 64 on multiple lines 106. Also connected to the remote annunciator unit 64 is a hard copy printer 136, which may be of the conventional kind.

As a further safeguard in maintaining the integrity of the system, a door tamper switch 138 is connected to the amplifier rack so that a signal may be given if the amplifier rack is tampered with in any fashion, such as by an unauthorized opening of the rear panel.

As seen in FIG. 4, all remotely located devices are connected to the central control and display system through transponders. The transponder interprets the address signals which it receives from the fire command station and the amplifiers and sends a signal back to the fire command station based upon the condition of the outlying device to which it is connected.

A typical transponder is shown in FIG. 5. The clock and sync signals on lines 46 and 44, respectively, produced by the clock 30 and the binary counter 34 of the system of FIG. 2, are fed to an address unit 138, which contains a binary counter 139 producing parallel output signals on lines 140 fed to an address decoder unit 141. This counter 139 is then seen to translate the serial clock signal on line 44 and the sync signal on line 46 into the parallel address which is decoded by the address decoder 141. The binary counter 139 is similar to the binary counter 34 of FIG. 2. An address decoder 141 is a part of every transponder and, as pointed out, there is an individual transponder unit for each sensing and/or actuating system. Upon decoding the address assigned to that particular transponder, the address decoder 141 causes line 142 to go high. Line 142 is connected to a logical AND gate 144. The other input to the AND gate 144 is provided on line 145 from the logic 146 associated with a remote sensor unit 147. The remote sensing unit 147 has a set of contacts 148 in series with a sensor represented by resistor 149 and an end of line resistor 150 in parallel with the sensor and contacts. The end of line resistor 150 provides a continuous current path when the sensor contacts 148 are open. In this fashion, if the remote sensor 147 is damaged or removed, the current path will be broken, a condition easily sensed by the logic unit 146. In this regard, the logic unit 146 can comprise conventional logic elements and voltage or current comparators, since it is only required to determine if the contacts 148 are closed or if the resistor 150 is missing. Such logic design is well within the skill of one with ordinary capabilities in the logic design art. The remote sensor unit 147 and its logic 148 provide two states or indications, one an alarm or trouble indication on line 151 when contacts 148 are closed or when resistor 150 is open or missing, and one a normal indication on line 145. The alarm indication on line 151 is connected to a second AND gate 152. The other input to the second AND gate 152 is the high signal from the decoded address produced by the address decoder 141 on line 142.

When the address code for the particular transponder is decoded from the clock 44 and sync 46 lines by the binary counter 139 and address decoder 140, it is applied to AND gates 144 and 152 to which are connected, respectively, the normal output of the remote sensor 148 and logic 146 on line 145 and the alarm output on line 151. When the address code of the particular transponder has been decoded, and the remote device 147 is in its normal state, the AND gate 144 will produce a high output on line 152, connected to an invertor unit 156. The output of the invertor 156 on line 158 is a low signal which is placed on the return signal line 160 and fed back to the main control logic of the system.

The return signal line 160 corresponds to the monitoring line 48 of FIG. 2. If the remote device 147 is removed or open, due to wire or transponder failure or degradation of the sensing unit, AND gate 144 will produce a low output or no output which, when fed to the invertor 156, will place a high signal on line 58 and onto the return signal line 160. Similarly, if the transponder address is decoded on line 142 and the alarm signal is present on line 151, AND gate 152 will produce a high output on line 162 which is placed onto the return signal line 160, thereby indicating an alarm condition at that particular transponder. This signal is then fed to the display logic where it will cause the corresponding alarm indicator to be activated and the appropriate communication signals to be issued.

A second type of remote unit is located at this transponder, and this is the actuator 164 for executing commands initiated at the control logic. This actuator unit 164 may comprise a relay which, when provided with the appropriate signal, will open or close its contacts. The control signal for the actuator 164 appears on line 166 and is the output of a third AND gate 168. One input to the AND gate is the decoded address signal on line 142 from the address unit 138. The other input to the actuation AND gate 168 is on line 170 from a command bus 172 connected to the control logic. Thus, when the command bus 172 is high and the address signal on line 142 is present, the relay 164 will be operated. The relay contacts are used to control the operation of whatever type of device is connected to it, door strikes, fan controllers, and elevator controllers. It is understood, that if necessary a voltage source or other interface module may be connected between the output relay of the transponder and the actual device to be actuated or controlled.

It is pointed out that the signal appearing on the command bus 172 may be placed there automatically by the PROM, the minicomputer, or the switches in the multiplexer. These automatic responses are initiated once a trouble or alarm signal is received by the control logic. The automatic responses are programmed into the system either by the manual switches in the multiplexer, by the programmable read only memory, or by the minicomputer, connected as shown in FIG. 2.

Referring back to the multiplexer 40 of FIG. 2, if an alarm signal is generated, the multiplexer will automatically issue certain operating commands which can be used to control the elevators, to stop or start the ventilating fans, turn on the speakers on the selective floors, sound the alarms, and issue a signal to the central office system. The selected alarm addresses are connected to the multiplexer either through a set of manual switches such as shown in 50 or through a programmable read only memory (PROM) 54. The PROM 54 also provides the capablility to issue commands on lines 106 fed to the amplifier 62 to initiate various communication functions, such as to start the evacuation tone, to start the chaser tone, or to initiate the inquiry tone.

The amplifier rack, 62 of FIG. 4, provides the present system with amplifiers and signal processing equipment required to operate loudspeakers located throughout the building, such as in the corridors, the elevator lobby area, and the stairs and to cause the required tones and signals to be sounded throughout the building. These loudspeakers are necessary to transmit fire safety inquiry signals, evacuation signals, and paging announcements. The amplifier rack is preferably located in a protected area within the building. The actual physical embodiment of the system is dependent upon the number of amplifiers required for the number of speakers employed. The present invention provides a dual system wherein each complete system operates only one half of the speakers within a floor or area. This redundancy provides a highly reliable system such that if there is a failure of a part of the system, at least half of the loudspeaker will remain operational.

Once an alarm signal from a specific remote device is placed on line 48 and the address of that device is decoded, then the appropriate flip-flop 148 lights the corresponding lamp 47. The flip-flop output is also fed to the multiplexer 40 and the PROM 54, if one is employed, to identify the remote device undergoing the alarm condition. The next time the address of the remote device is decoded by the binary decoder, the multiplexer will issue a command on line 52.

Figure 6:
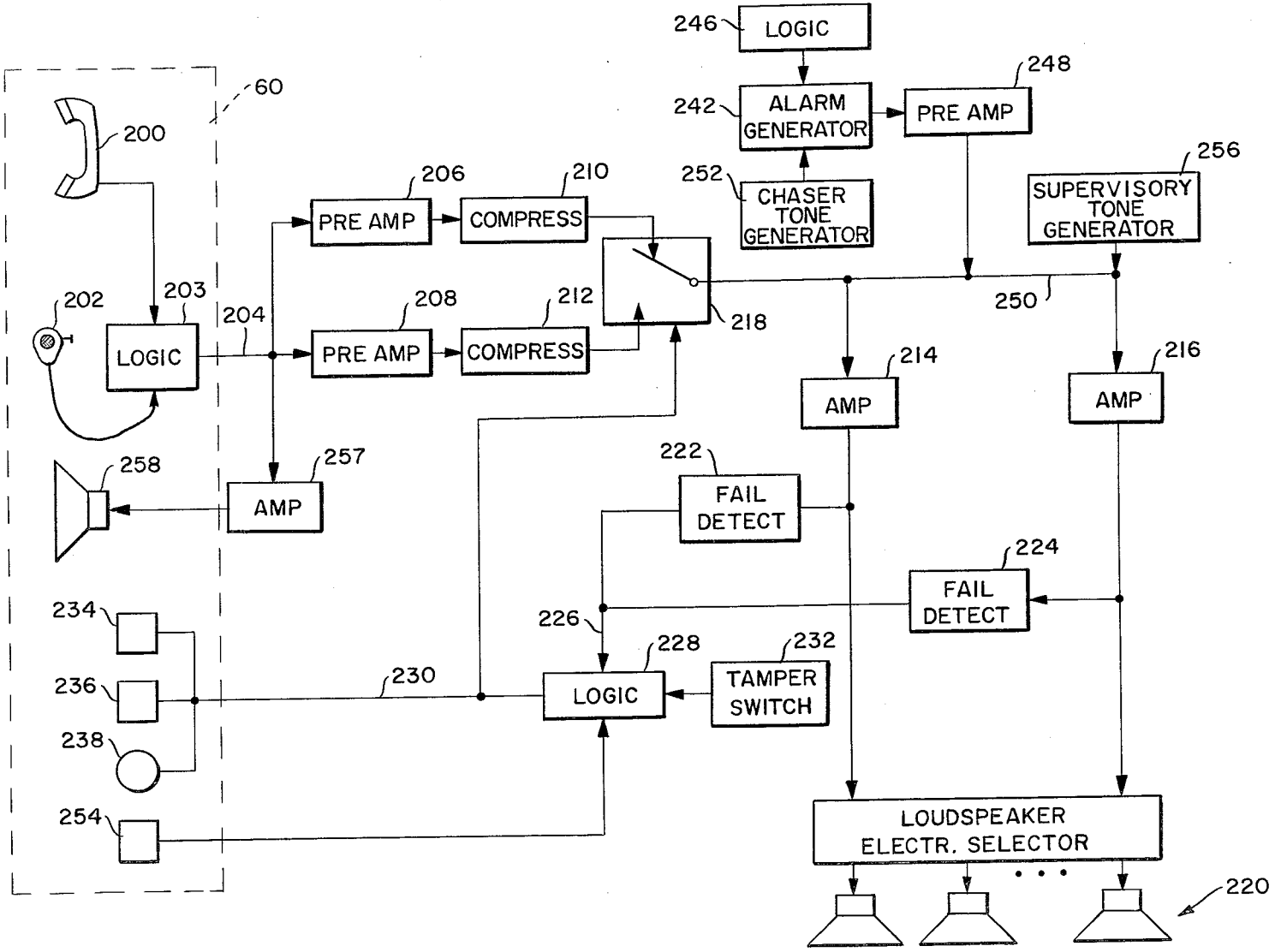
FIG. 6 is a block diagram of the amplifier portion of the present invention.

Referring to FIG. 6, the paging source to be transmitted over the loudspeakers is selected at the fire command station 60, and the signal source may either be one of the warden station handsets 200 or the push-to-talk microphone 202 of the fire safety director. These signals are fed to a control logic 203 which makes sure that only one input signal at a time is fed to the amplifier system. The single audio signal is placed on line 204 and fed to two individual preamplifiers, 206 and 208. The audio signal is amplified in both preamplifiers and each preamplified signal is fed to a compressor, 210, 212, respectively, which limit the dynamic range of the preamplified audio signal in order to compensate automatically for the speech level differences among different persons making announcements. The compensators 210, 212 also suppress any static or other undesired electrical noise associated with the audio signal. The audio output signal from one set of preamplifiers and compressors is fed to a pair of power amplifiers, 214 and 216, through a transfer relay 218. Each power amplifier 214, 216 has its output signal fed to a specific set of speakers for each floor, as shown generally at 220. Also provided at the output of the power amplifiers, 214 and 216, are failure detectors, 222 and 224, respectively which detect the loss of output signal from the amplifier and provide a signal on line 226 to a control logic unit 228. The manner in which the failure detectors 222, 224 operate will be explained hereinbelow. When a failure is detected, the output from the logic unit 228 is fed on line 230 to the fire command station 60. The signal on line 230 also controls the transfer relay 218, which serves to switch the audio input signals to the unaffected amplifier channel. The door tamper switch 232 senses any tampering at the doors of the amplifier rack and provides a signal to the failure logic 228 for producing an output on line 230. The failure signal on line 230 is also fed back to the fire command station 60 and is used to indicate door trouble at indicator 234, amplifier failure at indicator 236, and to sound an audible alarm from buzzer 238, to advise the personnel of the ongoing failure.

When the alarm evacuation tone is to be transmitted over the loudspeakers a separate circuit is provided. Specifically, an alarm generator 242 is provided which is triggered by signals from a control logic unit 246. A separate preamplifier 248 is provided for the alarm signal and its output is placed on the input lines 250 to the main power amplifiers, 214 and 216.

Similarly, when the alternating chaser tone is to be transmitted over the loudspeakers, a separate circuit is provided as an input to the alarm generator 242, and this separate circuit is shown at 252. When this chaser tone generator 252 is activated, its signal is amplified in preamplifier 248 and fed to the inputs 250 of both power amplifiers, 214 and 216.

The amplifier failure detection system operates by a supervisory tone generator 256 applying an inaudible tone, i.e., one above 21 KHz, to the power amplifiers. The failure detectors, 222 and 224, can easily be designed to detect the presence of this ultrasonic signal superimposed on the output signals from the power amplifiers. If the tone is not present, then the failure detectors, 222 or 224, produce a signal on line 226 indicating the failure of an amplifier or shorted speaker lines. This signal on line 226 is fed to the logic unit 228, which then produces a signal on line 230 which is fed to the switch 218 and also back to the fire command station 60. The switch 218 disconnects the failed amplifier from the input signal and may also be used to actually disconnect the AC power from the affected amplifier. The signal fed to the fire command station enables the amplifier trouble lamp 236 and sounds the audible alarm 238. The door interlock switch 232 prevents tampering with the audio equipment and, if the switch is actuated, a signal is also fed to the fire command station 60 to enable the door trouble lamp 234 and the audible alarm 238. A reset switch 254 is provided at the fire command station and is used to reset the failure alarm logic 228 to discontinue the alarm indications.

An additional amplifier 257 is provided to monitor the actual signals fed to the loudspeaker system. The output of the monitoring amplifier 257 is fed back to a loudspeaker 258 located at the fire command station 60.

The operation of the inventive system can be divided essentially into two classifications, i.e., alarm operations and communications operations. When an alarm condition is discovered by the present invention, an important point is that a confirmation of the alarm as a real fire condition or as a false alarm should be made. Although the inventive system is intended for automatic operation, the situation does exist where a false alarm could result from tobacco smoke or equipment failure. As an example of a false alarm situation, when an alarm condition is detected by any of the remote detection devices, a series of operations are automatically performed at the fire command station. Referring back then to FIG. 4, when a detector such as the product of combustion or ionization detector 114 signals a fire condition through the transmission terminal box 108 to the fire command system 60, an alarm lamp is lit at the floor position and detector type position on the annunciator panel 68. The "FIRE" signal 74 also flashes on and off, and a signal is sent to the transmitting equipment for the central station alarm. An alarm signal indicator at the audio control panel 72 will also be illuminated to indicate that the automatic alarm signal has been sent to the central office equipment. Also, an alarm tone will be sounded at the fire command station, and on the floor where the alarm signal originated, as well as on the floor directly above the affected floor. The floor alarm signals will also be issued over the loudspeaker located on those particular floors. If the system has been so programmed, control signals are sent to the actuators on the command lines, such actuators being the door strikes 212 and/or the fan and damper controls 118. An audible alarm signal and a floor and detector type indication are also sent to the remote annunciator 64. The floor page indicators on the annunciator panel 68 of the fire command station 60 indicate that the loudspeakers for the affected floor, as well as the floor directly above it, have been activated and are ready to receive the alarm evacuation tone and other paging announcements.

System failure caused by wiring faults between the sensing device and the corresponding transponder or an actual failure of the transponder electronics are automatically sensed by the system. When a trouble condition occurs, a lamp is illuminated at the fire command station for the type of device shown in both the alarm floor on the annunciator panel 68 of the fire command station 60. Similarly, a trouble signal is sounded at the fire command station and the light is illuminated. As pointed out in connection with the system of FIG. 6, if the trouble is at the amplifier rack it can either be an amplifier failure or be caused by tampering with the equipment cabinet door.

Referring to the communications operations, communication is possible between the floor warden stations, the command station and the loudspeakers at the various floors of the building. A floor warden can initiate communications with the fire command station by opening the station at his floor and pressing the call button. The fire command station will then receive a signal tone and a lighted indication at the floor position and the warden station column at the annunciator panel 68 of fire command station 60. The communications link is completed when the fire safety director depresses the corresponding button at the floor warden column and floor position on the annunciator panel. The fire safety director, by means of the present invention, can page any or all floors throughout the building to make announcements. Additionally, when an alarm condition exists the affected floor and the floor directly above it are automatically signalled with alarm tones; however, paging will override this alarm signal.

It is understood of course that the foregoing is presented by way of example only and is not intended to limit the scope of the present invention except as set forth in the following claims.

What is claimed is:

1. A building alarm, communication, and operating system, comprising:

a centrally located control unit;

a plurality of sensing units each having an individual address and being located remotely from said centrally located control unit;

a plurality of operating devices each having an individual address and being located remotely from said centrally located control unit;

said control unit including a clock means producing a clock signal and a synch signal generating means for producing a synch signal from said clock signal;

a first conductor connecting said clock means to a plurality of convertor and decoder means remotely located with each of said plurality of sensing units and said plurality of operating devices for continuously feeding said clock signal thereto;

a second conductor connecting said synch signal generating means to each of said plurality of convertor and decoder means for feeding said synch signal thereto;

each of said plurality of convertor and decoder means containing an address unique to one of said sensing units and operating devices;

a third conductor connecting each of said plurality of sensing units to said control unit for feeding a monitoring signal from said sensing units to said control unit;

a plurality of loudspeakers being located remotely from and electrically connected to said centrally located control unit;

communication means connected to said plurality of loudspeakers and said control unit for permitting bidirectional communication between said plurality of loudspeakers and said centrally located control unit;

display means electrically connected to said centrally located control unit and connected to receive said monitoring signal from said plurality of sensing units for indicating whether any sensing device has sensed an emergency condition; and command means connected to receive said clock signal for producing an actuation command signal fed on a fourth conductor to said plurality of remote operating devices for causing selected ones of said operating devices to perform a work function, whereby personnel at said centrally located control unit can communicate with remote locations and can be informed of various conditions detected by said sensing devices.

2. The system of claim 1, wherein said convertor and decoder means comprises a transponder connected between said centrally located control unit and each of said plurality of sensing units and said plurality of operating devices by said first and second conductors, said transponder including a serial to parallel convertor and an address decoding means for decoding the unique address and means for enabling said remote sensing device and said remote operating device upon the occurrence of the unique address.

3. The system of claim 1, wherein said communication means comprises a plurality of amplifier means arranged in a plurality of parallel channels, said parallel channels connected to corresponding ones of said plurality of loudspeakers for providing amplified audio signals to said plurality of loudspeakers over said plurality of parallel channels.

4. The system of claim 3, further including at least two preamplifiers arranged in two parallel channels for preliminarily amplifying the input audio signals, selector switch means connected to the output signals from said preamplifiers and being operable to select an output signal therefrom, and failure detection means connected to said plurality of amplifier means for producing a selection signal fed to said selector switch for causing said selector switch to select one output signal from said preamplifiers.

5. The system of claim 4, further comprising at least one speech compressor means arranged electrically in each of the two channels and being connected to receive the preamplified audio signals for providing amplitude compression of such audio signals.

6. The system of claim 1, wherein said command means comprises local convertor means connected to receive said clock signal for producing a plurality of parallel signals therefrom and a programmable read only memory having the unique address of preselected ones of said operating devices contained therein and connected to decode said plurality of parallel signals from said local convertor means for producing said actuation command signal upon receiving said monitoring signal from a sensing unit and the occurrence of the address of the preselected operating device for providing command signals fed to said communication means.

7. The system of claim 1, wherein said command means comprises a multiplexer unit having a plurality of individual switches connected to permit selection of the unique address of at least one operating device, said multiplexer unit being connected to receive said monitoring signal and a serial to parallel convertor connected to said clock signal for producing a plurality of parallel signals fed to said multiplexer, said multiplexer unit producing said actuation command signal upon the occurrence of a selected unique address and a monitoring signal from the sensing unit having the selected address.

8. The system of claim 1, wherein at least one of said plurality of sensing devices includes an end-of-line resistor for providing a continuous current path whether or not said at least one sensing device has not sensed a desired parameter.

9. The system of claim 4, further including means for producing a supersonic signal on both of said parallel channels, said failure detector means being connected to receive said amplified audio signal and for producing said selection signal upon the failure to detect said supersonic signal.

10. A system for use in a building, the system comprising:

a control unit;

a plurality of sensing units for sensing the presence or absence of a desired environmental parameter, each having an individual address and being located remotely from said control unit;

a plurality of operating units each having an individual address and being located remotely from said control unit;

said control unit including a central clock means producing a clock signal, a central serial to parallel convertor for producing a plurality of parallel signals from said clock signal, and a synch signal generating means for producing a synch signal from said plurality of parallel signals;

a first conductor connecting said clock means to a plurality of convertor and decoder means remotely located with each of said plurality of sensing units and to each of said plurality of operating devices for continuously feeding said clock signal thereto;

a second conductor connecting said synch signal generating means to each of said plurality of convertor and decoder means for feeding said synch signal thereto;

each of said plurality of convertor and decoder means producing an address unique to only one of said plurality of sensing units and operating units;

a third conductor connecting each of said plurality of sensing units to said control unit for feeding a monitoring signal from said sensing units to said control unit;

a plurality of loudspeakers electrically connected to said control unit;

communication means connected to said plurality of loudspeakers and said control unit for permitting communication between said plurality of loudspeakers and said centrally located control unit;

indicating means connected to said control unit and to said monitoring signal for indicating whether any sensing unit has sensed the presence or absence of a desired environmental parameter; and command means connected to receive said plurality of parallel signals for producing an actuation command signal fed on a fourth conductor to said plurality of operating units for causing selected ones of said operating devices to perform a work function.

11. The system of claim 10, wherein said plurality of convertor and decoder means comprises a plurality of transponders connected between said centrally located control unit and each of said remotely located sensing units and operating units by said first and second conductors and including a remote serial to parallel convertor and an address decoder means for decoding the unique address to said sensing unit and operating unit from said clock and said synch signals produced by said control unit and enabling said sensing unit and said operating units upon the decoding of the appropriate unique address.

12. The system of claim 10, wherein said communication means comprises a plurality of amplifier means arranged in at least two parallel audio channels, said parallel audio channels connected to said plurality of loudspeakers for providing amplified audio signals thereto.

13. The system of claim 12, further including at least two preamplifiers arranged in two parallel audio channels for preliminarily amplifying the audio signals fed to said plurality of amplifier means and selector switch means connected to the outputs from said preamplifiers and to a control signal for causing said selector switch to select one of the input signals.

14. The system of claim 10, wherein said command means comprises a programmable read only memory having the unique addresses of preselected ones of said operating units contained therein and connected to decode said plurality of parallel signals from said local convertor means for producing said actuation command signal upon receiving said monitoring signal and the decoding of a preselected unique address, for providing command signals fed to said communication means.

15. The system of claim 10, wherein said command means comprises a multiplexer unit having a plurality of individual switches connected to permit selection of the unique address of at least one operating unit, said multiplexer unit being connected to receive said monitoring signal and said plurality of parallel signals from said local convertor means for producing said actuation command signal upon the occurrence of the selected unique address and a monitoring signal.

16. The system of claim 10, wherein at least one of said plurality of sensing units includes an end-of-line resistor for providing a continuous current path whether or not said at least one unit has sensed a desired parameter.

17. The system of claim 13, further including means for producing a supersonic signal fed to said two parallel audio channels, failure detector means connected to receive said amplified audio signals for detecting the presence of said supersonic signals and for producing said control signal fed to said selector switch upon the failure to detect said supersonic signal.

* * * * *